US007210451B2

(12) United States Patent
Ikeda et al.

(10) Patent No.: US 7,210,451 B2
(45) Date of Patent: May 1, 2007

(54) THROTTLE CONTROL DEVICES

(75) Inventors: Tsutomu Ikeda, Aichi-ken (JP); Koji Yoshikawa, Aichi-ken (JP); Kazumasa Nakashima, Aichi (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/839,798

(22) Filed: May 6, 2004

(65) Prior Publication Data

US 2005/0155575 A1 Jul. 21, 2005

(30) Foreign Application Priority Data

May 8, 2003 (JP) ..... 2003-130434

(51) Int. Cl.
*F02D 11/10* (2006.01)

(52) U.S. Cl. ..... 123/399; 123/337; 324/207.21; 324/207.25

(58) Field of Classification Search ..... 123/337, 123/336, 399, 403, 583, 361; 324/207.21, 324/207.25; 73/117.2, 117.3, 118.1, 118.2
See application file for complete search history.

(56) References Cited

U.S. PATENT DOCUMENTS 5,490,487 A * 2/1996 Kato et al. ..... 123/399
5,544,000 A * 8/1996 Suzuki et al. ..... 361/139
5,640,089 A * 6/1997 Horikawa et al. ..... 324/212
5,698,778 A * 12/1997 Ban et al. ..... 73/118.1
5,789,917 A 8/1998 Oudet
6,356,073 B1 3/2002 Hamaoka
6,407,543 B1 * 6/2002 Hagio et al. ..... 324/207.25
6,483,296 B1 11/2002 Hamaoka
6,522,038 B2 * 2/2003 Byram ..... 310/71
6,593,734 B1 7/2003 Gandel
6,614,223 B2 9/2003 Schroeder
6,724,185 B2 4/2004 Ooki
6,756,780 B2 * 6/2004 Hagio et al. ..... 324/207.25
6,956,368 B2 * 10/2005 Johnson et al. ..... 324/207.25
7,036,791 B2 5/2006 Wiese
2002/0121894 A1 9/2002 Ooki

FOREIGN PATENT DOCUMENTS

JP 2002256896 9/2002

* cited by examiner

*Primary Examiner*—Stephen K. Cronin
*Assistant Examiner*—Johnny H. Hoang
(74) *Attorney, Agent, or Firm*—Dennison, Schultz & MacDonald

(57) ABSTRACT

A throttle control device includes a motor coupled to the throttle shaft, so that the throttle valve rotates to open and close an intake air channel as the motor is driven. A detection device serves to detect the degree of opening of the throttle valve and includes a pair of magnets and a sensor. The magnets are mounted to the throttle shaft via a magnet support and are positioned to oppose each other across the rotational axis of the throttle shaft in order to produce a uniform magnetic field. The sensor is mounted to the throttle body and serves to detect a direction of the magnetic field produced by the magnets, so that the detection device outputs a signal representing the degree of opening of the throttle valve.

22 Claims, 8 Drawing Sheets

THROTTLE CONTROL DEVICES

This application claims priorities to Japanese patent application serial number 2003-130434, the contents of which are incorporated herein by reference.

BACKGROUND OF THE INVENTION

1. Field of the Invention

The present invention relates to throttle control devices for controlling a flow rate of intake air supplied to an engine, e.g., an internal combustion engine of an automobile, and in particular to throttle control devices that are electrically or electronically controlled.

2. Description of the Related Art

Japanese Laid-Open Patent Publication No. 2001-59702 teaches a known throttle control device that includes a throttle valve disposed within an intake air channel formed in a throttle body. The throttle valve is rotatably driven by a motor in order to open and close the intake air channel, so that the flow rate of the intake air is controlled. The throttle control device further includes a throttle sensor (also known as "throttle position sensor") that detects the degree of opening of the throttle valve. The throttle sensor includes a pair of magnets and a magnetic detecting element, such as a Hall element. The magnets are attached to a support member. The support member is mounted to at throttle shaft that rotates in unison with the throttle valve, so the magnets are positioned to oppose to each other with respect to the rotational axis of the support member. The magnetic detecting element is mounted to the throttle body. The magnetic detecting element detects the intensity of the magnetic field produced by the magnets and outputs the detected intensity as signals that represent the degree of opening of the throttle valve.

However, because the magnetic detecting element detects the intensity of the magnetic field produced by the pair of magnets, the magnetic detection element may output incorrect signals if the pair of magnets has been offset from their initially set positions relative to the magnetic detection element. The offset could be due to possible displacement of the throttle shaft during a long period of use or due to thermal expansion of the molded resin that incorporates the magnets through an insert molding process. Such incorrect signals also may be outputted if the level of intensity of the magnetic field has been changed due to temperature-dependent characteristics of the magnets. For these reasons among others, the detection accuracy of the degree of opening of the throttle valve may be lowered, and therefore, the accuracy of the control of the flow rate of the intake air may also subsequently be lowered. This problem becomes more significant if the throttle body is made of a synthetic resin that has a large coefficient of thermal expansion or if the throttle body is made of a material that cannot be accurately formed or machined. Therefore, it has been desired to improve the known throttle control devices and reduce these problems.

To this end, Japanese Laid-Open Patent Publication No. 8-35809 has proposed a device 101*a* for detecting a rotational angle, as shown in FIG. 6 of the publication, in which a pair of stators 160 and 161, each having a semi-circular cross section, are disposed within the yoke 110. A gap 162 is formed between the stators 160 and 161. The sensor 170 is positioned within the gap 162 for detecting the strength of a magnetic field. With this arrangement, the direction of the magnetic field is directed in primarily one direction, i.e., a direction indicated by the arrows shown across the gap 162 as viewed in FIG. 6 of the publication. The magnetic field is most unidirectional particularly where the magnetic field lines intersect the sensor 170, throughout a change in the rotational angle of the yoke 110. Therefore, the sensor 170 can properly detect the rotational angle of the rotary shaft over the entire range of rotation.

However, incorporation of the stators 160 and 161 may increase the total number of parts required for a device used in detecting rotational angles and therefore may increase the overall manufacturing cost. In addition, an increase in the number of parts may consequently demand increased accuracy in the assembling operation.

SUMMARY OF THE INVENTION

It is accordingly an object of the present invention to teach improved throttle control devices that can accurately detect the degree of opening of a throttle valve.

According to one aspect of the present teachings, throttle control devices are taught that include a throttle body defining an intake air channel. The throttle control device also includes a throttle shaft that is able to rotate about a rotational axis. A throttle valve is mounted to the throttle shaft and disposed within the intake air channel. A motor is coupled to the throttle shaft, so that the throttle valve rotates to incrementally open and close the intake air channel so as to control the flow rate of intake air. A detection device serves to detect the degree of opening of the throttle valve and may include at least two magnets and a sensor. The magnets are mounted to the throttle shaft via a magnet support. In addition, the magnets are positioned to oppose to each other across the rotational axis, so as to produce a magnetic field. The sensor is mounted to the throttle body and serves to detect the direction of the magnetic field produced by the magnets, so that the detection device outputs a signal representing the degree of opening of the throttle valve.

Because the sensor detects the direction of the magnetic field produced by the magnets, the output signal may not be substantially influenced by the potential offset of the magnets from their set positions or by the potential change of the strength of the magnetic field of the magnets. Therefore, the degree of opening of the throttle valve can be accurately detected. For example, the magnets may be offset from their initial set positions when the position of the throttle shaft has been offset due to wear during a long period of use. In the case where the magnet support is made of resin and integrally molded containing the magnets via an insert molding process, the magnets may be offset from their initially set positions due to thermal expansion of the resin. In addition, the strength of the magnetic field may change due to the temperature characteristics of the magnets.

In another aspect of the present teachings, the throttle control device further includes a ring-shaped yoke that is made of magnetic material and is mounted to the magnet support. The yoke has substantially the same axis as the rotational axis of the throttle shaft. The magnets are attached to an inner peripheral surface of the yoke. The magnets are magnetized to produce a substantially uniform magnetic field represented by substantially parallel, unidirectional, magnetic field lines.

The production of substantially parallel, unidirectional magnetic field lines by the magnets, improves the accuracy of the detection of the direction of the magnetic field.

In another aspect of the present teachings, each of the magnets extends along an angle measured about the rotational axis. The angle is determined such that an error in the sensor output signal due to an offset away from the ideal set positions of the magnets or detection device, is such that the error is less than a predetermined value. The error in the outputted signal may be due to an offset of a position of at least one of the magnets and the detection device relative to at least one of the other of the magnets and the detection device, away from ideal set positions.

This arrangement may further improve the detection accuracy.

In another aspect of the present teachings, the magnet support comprises a throttle gear mounted to the throttle shaft. No separate magnet support is required for the magnets.

In another aspect of the present teachings, the sensor comprises a holder attached to the throttle body and a sensing element disposed within the bolder. For example, the sensing element may be a magnetoresistive element or a Hall element.

In another aspect of the present teachings, the holder has a bottomed tubular configuration having an open end, The sensing element is fixed in position within the holder by filling resin into the holder. Therefore, the sensing element can be reliably maintained in the set position.

In another aspect of the present teachings, the sensing element comprises a sensing section and a computing section that are integrated with one another. The result is a compact construction for the sensing element.

In another aspect of the present teachings, the sensing element has a substantially square configuration. The sensing element is positioned on the rotational axis of the throttle shaft.

In another aspect of the present teachings, the sensor further includes a circuit board. The circuit board is electrically connected to the sensing element. The circuit board is positioned so as to substantially close the open end of the holder.

In another aspect of the present teachings, the throttle body includes a removable cover. The sensor is mounted to the removable cover. This aspect facilitates the assembly operation of the sensor.

DETAILED DESCRIPTION OF THE INVENTION

Each of the additional features and teachings disclosed above and below may be utilized separately or in conjunction with other features and teachings to provide improved throttle control devices and methods of using such improved throttle control devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
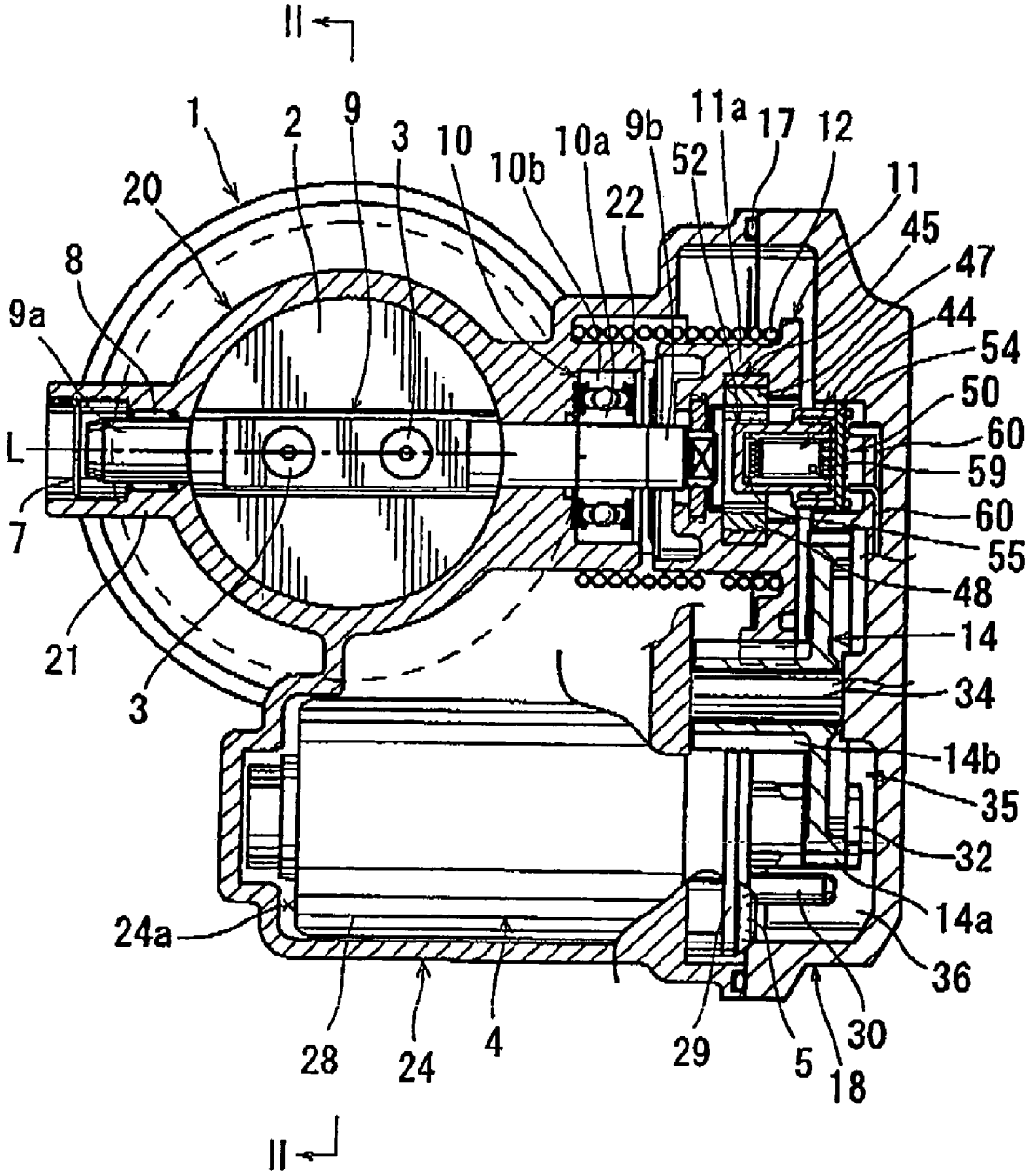
FIG. 1 is a sectional plan view of a representative throttle control device.
Figure 2:
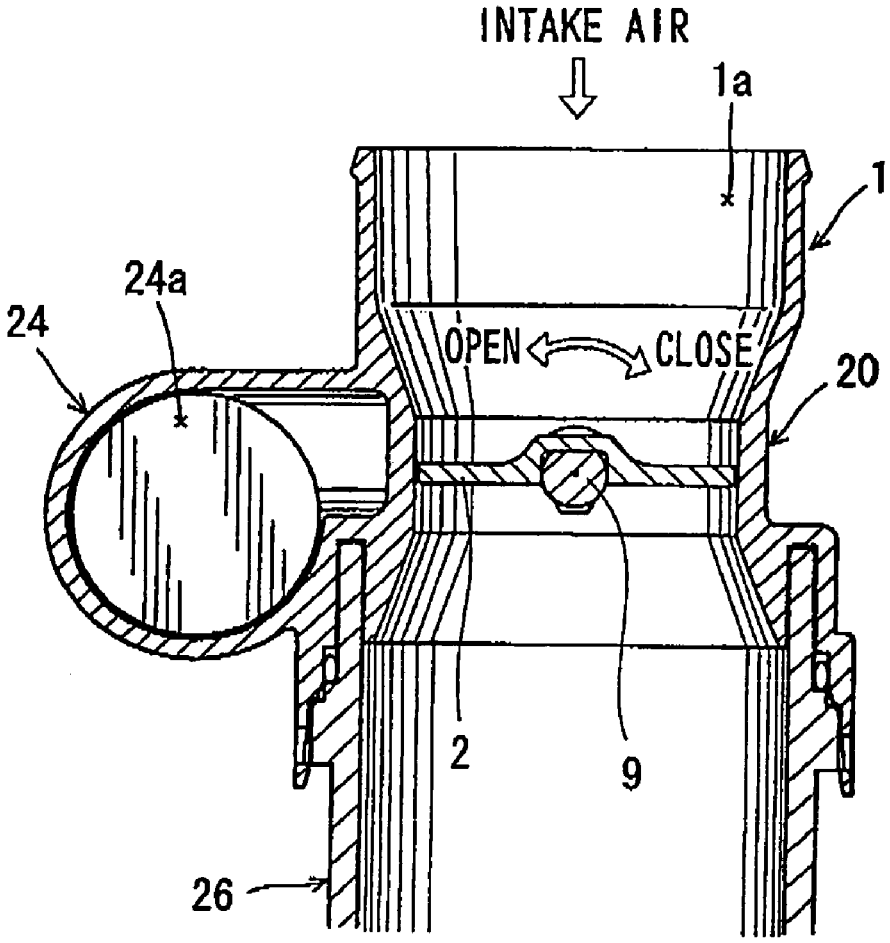
FIG. 2 is a cross sectional view taken along line II—II in FIG. 1.

A representative embodiment will now be described with reference to the drawings. First, the construction of a representative throttle control valve will be described in brief. Referring to FIGS. 1 and 2, the throttle control valve includes a throttle body 1 that is made of resin. The throttle body 1 has a bore portion 20 and a motor housing portion 24 that are formed integrally with one another. As shown in FIG. 1, a substantially cylindrical intake air channel 1*a* is formed in the bore portion 20 and extends vertically as viewed in FIG. 2 through the bore portion 20. An air cleaner (not shown) may be connected to the upper part of the bore portion 20. An intake manifold 26 is connected to the lower part of the bore portion 20. In the drawings, only a connecting portion of the manifold 26 is shown. A metal throttle shaft 9 is disposed within the bore portion 20 and extends across the intake air channel 1*a* in the diametrical direction.

As shown in FIG. 1, left and right support portions 21 and 22 rotatably support the throttle shaft 9 via respective left and right bearings 8 and 10. The support portions 21 and 22 are formed integrally with the bore portion 20 of the throttle body 1. Preferably, the left bearing 8 is a thrust bearing and the right bearing 10 is a radial ball bearing. The throttle shaft 9 is press fitted into an inner race 10*a* of the right bearing 10. The outer race 10*b* of the right bearing 10 is fitted with clearance into the support portion 22 of the resin throttle body 1. The loose fitting of the outer race 10*b* has been incorporated in order to avoid cracking of the support portion 22. The dimensional tolerance of the diameter of the inner peripheral surface of the support portion 22 is relatively large because the throttle body 1 is made of resin. In addition, the thermal linear expansion coefficient of the support portion 22 is considerably different from that of the bearing 10. Therefore, when the outer race 10*b* has been press fitted into the support portion 22, the press-fitting force may possibly crack the support portion 22. On the other hand, in the case where the throttle body 1 is made of metal, such as aluminum alloy for example, the inner peripheral surface of the support portion 22 may be machined (cut) to within a relatively small dimensional tolerance. The metal throttle body 1 may also have a relatively small difference in the thermal linear expansion coefficients between the support portion 22 and the bearing 10. Therefore, in such a case, the outer race 10*b* may be press fitted into the support portion 22 without causing any cracking problem.

As shown in FIG. 1, a throttle valve 2 made of resin is secured to the throttle shaft 9 by rivets 3, and the throttle valve 2 is adapted to open and close the intake air channel 1*a* (see FIG. 2) as it rotates with the throttle shaft 9. The motor 4 rotatably drives the throttle shaft 9, so that the throttle valve 2 rotates to incrementally open and close the intake air channel 1*a*. The throttle valve 2 rotates in order to control the flow rate of the intake air within the intake air channel 1*a*. In the state shown FIG. 2, the throttle valve 2 is in a fully closed position. The throttle valve 2 may rotate in a counterclockwise direction as viewed in FIG. 2 ("Open" direction as indicated by an arrow shown in FIG. 2) to open the intake air channel 1*a*.

As shown in FIG. 1, a plug 7 is fitted into the support portion 21 that forms a first end 9*a* (left end as viewed in FIG. 1) of the throttle shaft 9. The plug 7 serves to scal the first end 9*a* within the bore portion 20. A second end 9*b* (right end as viewed in FIG. 1) of the throttle shaft 9 extends through the support portion 22. A throttle gear 11 is secured to the second end 9*b* and does not rotate relative to the throttle shaft 9. The throttle gear 11 is made of resin and is configured as a sector gear. A return spring 12 is interposed between the throttle body 1 and the throttle gear 11 in order to normally bias the throttle valve 2 toward the fully closed position. Although not shown in the drawings, a stopper device is provided between the throttle body 1 and the throttle gear 11 in order to prevent the throttle valve 2 from rotating further beyond the fully closed position.

As shown in FIG. 1, the motor housing portion 24 of the throttle body 1 is configured as a bottomed hollow cylindrical member that has a central axis parallel to a rotational axis L of the throttle shaft 9. As shown in FIG. 2, a motor accommodating space 24*a* is defined within the motor housing portion 24 and is open on a right side as viewed in FIG. 1. The motor 4 is inserted into the motor accommodating space 24*a*. For example, the motor 4 may be a DC motor. In the accommodated state, the motor 4 is positioned such that the longitudinal axis of the motor 4 extends substantially parallel to the rotational axis L of the throttle shaft 9. The output shaft 4*a* (see FIG. 3) of the motor 4 is oriented rightward as viewed in FIG. 1 (i.e., a direction opposite to the inserting direction of the motor 4 into the motor accommodating space 24*a*). As shown in FIG. 1, a mount flange 29 is formed on the right end (one end opposite to the motor insertion direction) of a motor casing 28, i.e., an outer hull, of the motor 4. The mount flange 29 is secured to the motor housing portion 24, by means of screws 5 for example.

Figure 3:
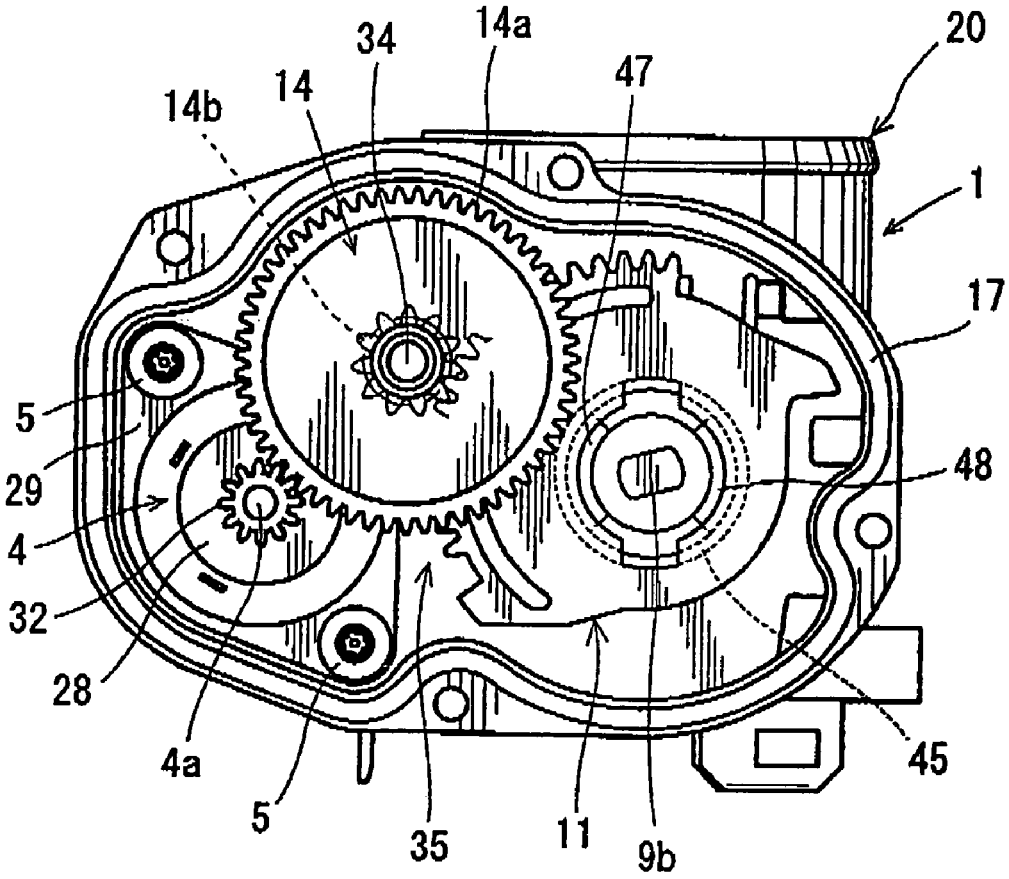
FIG. 3 is a side view of the throttle control device with a cover removed.

As shown in FIG. 3, a motor pinion 32 is secured to the output shaft 4*a* of the motor 4. The motor pinion 32 may be made of resin. As shown in FIG. 1, a countershaft 34 is mounted to the throttle body 1 in a position between the bore portion 20 and the motor housing portion 24. The countershaft 34 extends parallel to the rotational axis L of the throttle shaft 9. A counter gear 14, made of resin, is rotatably supported on the countershaft 34. The counter gear 14 includes a first gear portion 14*a* and a second gear portion 14*b*, having different outer diameters from one another. The first gear portion 14*a*, having a relatively larger outer diameter, engages the motor pinion 32. The second gear portion 14*b*, having a smaller outer diameter, engages the throttle gear 11 (see FIG. 3). The motor pinion 32 and the counter gear 14 constitute a speed reduction gear mechanism 35.

As shown in FIG. 1, a cover 18 is mounted to the right side of the throttle body 1 in order to cover the reduction gear mechanism 35 and other associated mechanisms from the outside. The cover 18 may be fixed in position relative to the throttle body 1 by an appropriate mounting device, for example, such as a snap-fit device, a screw device, and a clamp device, among others. An O-ring 17 is interposed between the throttle body 1 and the cover 18 in order to provide a hermetic seal therebetween. In this way, the cover 18 may serve as a component of the throttle body 1. Two motor terminals 30 (only one terminal 30 is shown in FIG. 1) extend from the mount flange 29 of the motor 4 and are electrically connected to respective relay connectors 36 mounted to the cover 18. Although not shown in the drawings, connecting terminals are integrated with the cover 18 via an insert molding process of the cover 18. One end of each connecting terminal is electrically connected to the corresponding relay connector 36. The other end of each connecting terminal extends into a connector formed on the cover 18.

The motor 4 may be controlled based on signals from a control unit, such as an ECU (engine control unit), of an internal combustion engine of an automobile. The control unit may output signals to the motor 4 in order to control the opening degree of the throttle valve 2. For example, the output signals may include an accelerator signal with regard to the depression amount of an accelerator pedal, a traction control signal, a constant-speed travelling signal, and an idling speed control signal. The rotation or the driving force of the motor 4 may be transmitted to the throttle shaft 9 via the reduction gear mechanism 35 (i.e., the motor pinion 32 and the counter gear 14) and the throttle gear 11.

As shown in FIG. 1, the throttle gear 11 has a substantially cylindrical tubular portion 11*a* that is positioned to extend rightward of the right end surface of the throttle shaft 9. The tubular portion 11*a* has the same axis as the rotational axis L of the throttle shaft 9. A yoke 45 is formed integrally with the inner peripheral surface of the tubular portion 11*a* through an insertion molding process of the tubular portion 11*a*. The yoke 45 is made of magnetic material and has a ring-shaped configuration substantially about the rotational axis L of the throttle shaft 9. A pair of magnets 47 and 48 (permanent magnets) is attached to the inner peripheral surface of the yoke 45. Magnets 47 and 48 are positioned to symmetrically oppose each other with respect to the rotational axis L of the throttle shaft 9. The magnets 47 and 48 are simultaneously integrated with the tubular portion 11*a* and the yoke 45 during the insertion molding process of the tubular portion 11*a*. Therefore, the yoke 45 and the magnets 47 and 48 are embedded within the tubular portion 11*a* in such a way that only the inner peripheral surfaces of magnets 47 and 48 are exposed to or communicate with the inside of the tubular portion 11*a*. In this way, throttle gear 11 serves as a support means for supporting the yoke 45 and the magnets 47 and 48.

Figure 4:
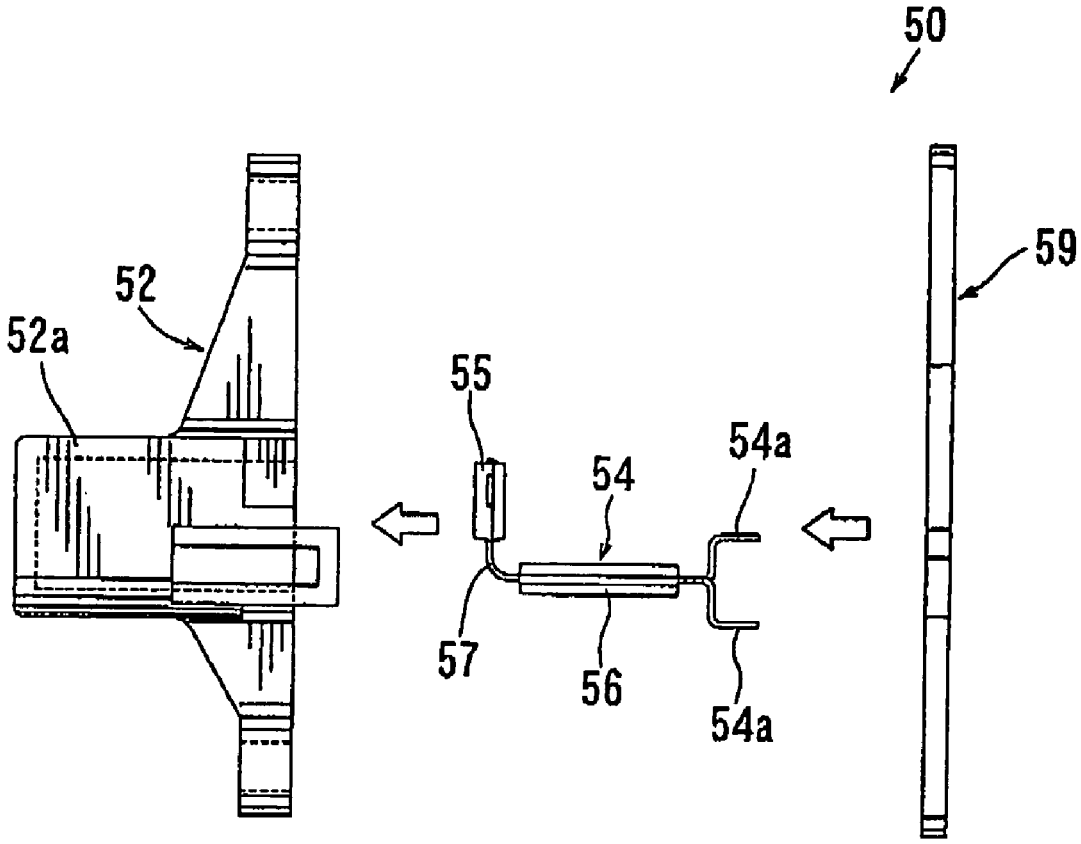
FIG. 4 is an exploded view of a sensor assembly.

A sensor assembly 50 is disposed inside of the cover 18 and is positioned opposing the right end of the throttle shaft 9. As shown in FIG. 4, the sensor assembly 50 includes a holder 52, a sensor IC 54, and a circuit board 59. The yoke 45, the magnets 47 and 48, and the sensor assembly 50, constitute a detection device 44 (see FIG. 1) that may serve as a throttle sensor.

As shown in FIG. 4, the holder 52 has a bottomed tubular portion 52*a* and is made of resin. The sensor IC 54 is a sensing element disposed within the tubular portion 52*a* of the holder 52. The holder 52 may be joined to the cover 18 (see FIG. 1) by an appropriate joining technique, such as crimping under beat, heat welding, and adhesion. The tubular portion 52*a* has a central axis that is along the same central axis of the yoke 45 and the rotational axis L of the throttle shaft 9. A resin, such as UV curable resin (not shown), may be filled within the tubular portion 52*a* in which the sensor IC 54 is disposed. The sensor IC 54 includes a sensing section 55 and a computing section 56 that are connected to each other. The sensing section 55 and the computing section 56 are electrically connected by means of terminals 57 (four terminals 57 are provided in the representative embodiment). The sensing section 55 may have a magnetoresistive element accommodated therein.

The sensing section 55 of the sensor IC 54 has a substantially square plate-like configuration. The computing section 56 has a substantially rectangular plate-like configuration. The terminals 57 are bent at substantially right angles, so that the sensor IC 54 has a substantially L-shaped configuration as shown in FIG. 4. The sensing section 55 of the sensor IC 54 serves to detect the direction of the magnetic field produced between the magnets 47 and 48. To this end, the sensing section 55 is positioned between the magnets 47 and 48 on the rotational axis L of the throttle shaft 9 such that the square surface of the sensing section 55 extends perpendicular to the rotational axis L. In addition, the tubular portion 52*a* of the holder 52 is disposed coaxially with the tubular portion 11*a* of the throttle gear 11 and in an intermediate position between the magnets 47 and 48.

The sensor IC 54 includes a full-bridge circuit (not shown) that includes a pair of magnetoresistive elements (not shown) disposed within the detecting section 55 and displaced from each other in the circumferential direction by an angle of 45°. The computing section 56 may calculate the arctangent of the output from the full-bridge circuit so as to produce linear output signals that correspond to the direction of the magnetic field. The linear output signals are supplied to the control unit. With this arrangement, the direction of the magnetic field can be detected without being influenced by change of strength of the magnetic field. As a result, the degree of opening of the throttle valve 2 can be detected as signals outputted from the sensor IC 54. The signals represent the direction of the magnetic field. The direction is obtained as a magnetic physical quantity of the magnets 47 and 48. In this way, the sensor IC 54 serves as a magnetic-field direction detecting device.

Based on the following, signals representing the degree of opening of the throttle valve 2 and outputted from the sensor IC 54, signals representing a travelling speed of the automobile and outputted from a speed sensor (not shown), signals representing the rotational speed of the engine and outputted from a crank angle sensor (not shown), signals representing a depression amount of an accelerator pedal and outputted from an accelerator pedal sensor, signals from an $O_2$ sensor (not shown), and signals from an airflow meter (not shown) among others, the control unit, i.e., an Engine Control Unit (ECU), may serve to adjust and control various parameters such as fuel injection control, correction control of the degree of opening of throttle valve 2, and variable speed control of an automatic transmission.

The circuit board 59 of the sensor assembly 50 (see FIG. 4) may be mounted to the holder 52 such that the open end of the holder 52 is closed by the circuit board 59. Preferably, a mount mechanism utilizing resilient deformation, such as a snap-fit mechanism, may be used for mounting the circuit board 59 to the holder 52. In addition, connecting terminals 54*a* of the sensor IC 54 are electrically connected to the circuit board 59 by soldering. Four terminals 60 (only two terminals 60 are shown in FIG. 1) are integrated with the cover 18 through an insertion molding process of the cover 18. The terminals 60 are electrically connected to the circuit board 59. The terminals 60 have connecting ends that extend into a connector portion (not shown) formed integrally with the cover 18.

Figure 5:
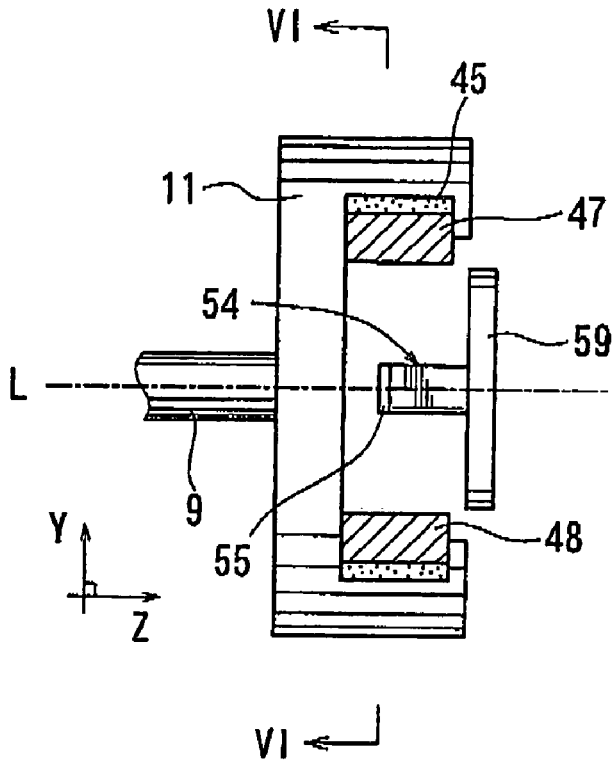
FIG. 5 is a schematic view showing magnets of a detecting device.
Figure 6:
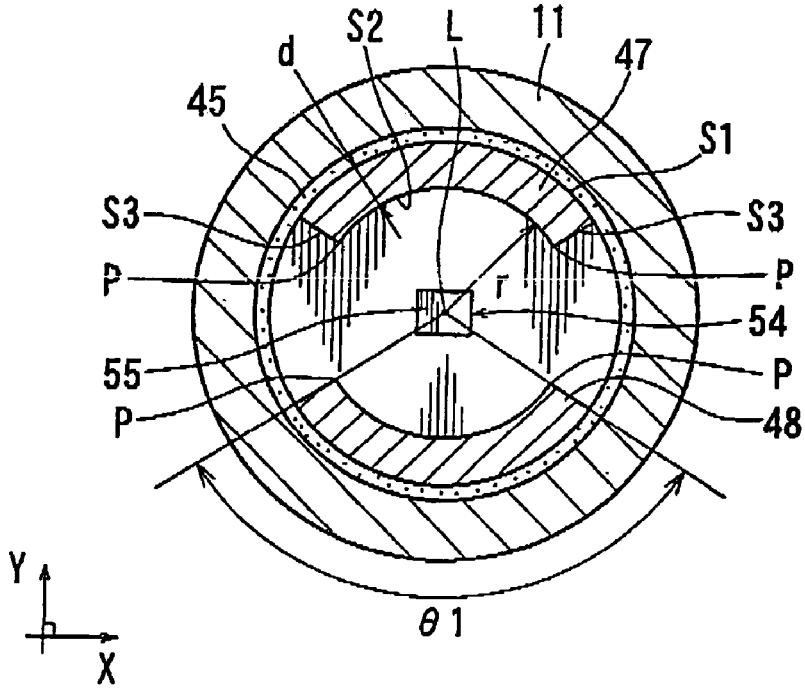
FIG. 6 is a cross sectional view taken along line VI—VI in FIG. 5.

Next, the arrangement of the magnets 47 and 48 will be described in detail. As shown in FIGS. 5 and 6, each of the magnets 47 and 48 has an arc-shaped configuration along the inner peripheral surface of the yoke 45. The magnets 47 and 48 are positioned symmetrically with respect to the rotational axis L of the throttle shaft 9. The magnets 47 and 48 are magnetized such that the magnetic lines of the magnetic field extend substantially parallel to each other in the vertical direction as viewed in FIGS. 5 and 6. In other words, the magnets 47 and 48 produce parallel magnetic lines within the inner space of the yoke 45.

Preferably, the magnets 47 and 48 may be made of ferritic magnet material. The ferritic magnetic material is advantageous for use because the ferritic magnetic material can be more easily formed to have an arc-shaped configuration than in comparison with rare earth magnet material. In general, ferritic magnet material is relatively soft but has a better toughness than rare earth magnet material. In addition, ferritic magnet material can typically be purchased at a lower cost than rare earth magnet material.

As shown in FIG. 6, each of the magnets 47 and 48 has an outer peripheral surface S1 and an inner peripheral surface S2. Both peripheral surfaces have arc-shaped configurations about the rotational axis L of the throttle shaft 9. In addition, each of the magnets 47 and 48 has a thickness d in the radial direction about the rotational axis L. The outer peripheral surface S1 has a radius or curvature that is substantially equal to the radius of curvature of the inner peripheral surface of the yoke 45. Further each of the magnets 47 and 48 has opposing circumferential end surfaces S3 that extend along the radial direction about the rotational axis L.

Figure 8:
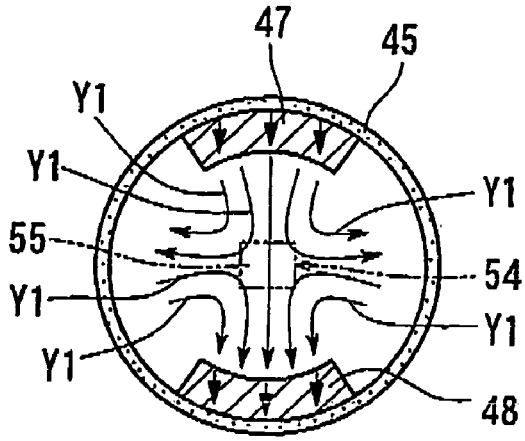
FIG. 8 is a view similar to FIG. 7 but showing the magnetic field lines that may be produced when the angular range of the magnets are tool small.
Figure 9:
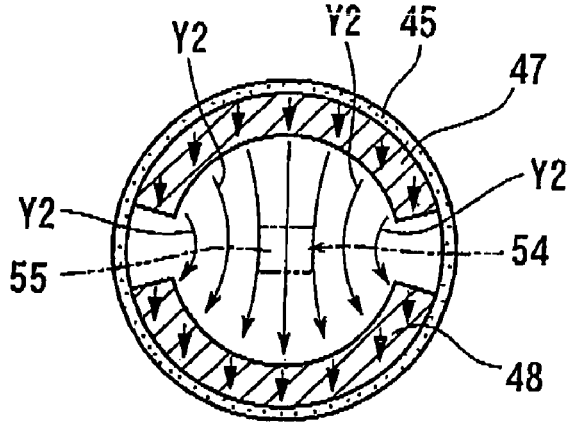
FIG. 9 is a view similar to FIG. 7 but showing the magnetic field lines that may be produced when the angular range of the magnets are too large.

Furthermore, as shown in FIG. 6, each of the magnets 47 and 48 has a circumferential length defined by an angle θ1 about the rotational axis L of the throttle shaft 9. In other words, circumferential edges P of the inner peripheral surface S2 are spaced from each other by an angle θ1 about the rotational axis L. The angle θ1 is chosen to minimize the possible error of the output signals to a predetermined value. The possible error from the sensor IC 54 may be caused due to displacement away from an ideal location of the magnets 47 and 48 in the radial direction, relative to the sensor IC. Thus, by choosing an appropriate angle value of the angle θ1, almost all of the magnetic lines (indicated by arrows in FIG. 7) may extend parallel to each other in the magnetic field produced by the magnets 47 and 48. However, if the angle θ1 is too small, as shown in FIG. 8, magnetic lines Y1 on both sides of the magnetic field may not extend parallel to central magnetic lines. Resulting in a potentially reduced region of parallel magnetic lines. On the other hand, if the angle θ1 is too large, as shown in FIG. 9, magnetic lines Y2 on both sides of the magnetic field also may not extend parallel to central magnetic lines. Again resulting in a potentially reduced region of parallel magnetic lines.

Figure 7:
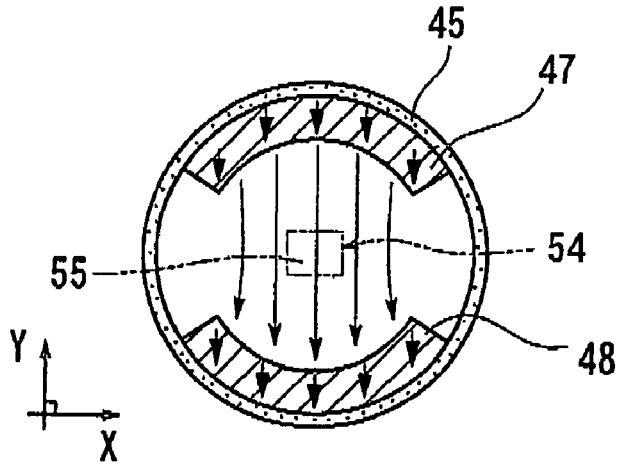
FIG. 7 is a cross sectional view showing magnetic field lines that may be produced when the angular range of the magnets are appropriately determined.

By choosing an appropriate angle θ1 such that almost all of the magnetic lines of the magnetic field produced by the magnets 47 and 48 may extend parallel to each other, as shown in FIG. 7, the output signals from the sensor IC 54 are consistent across some deviations of the positional relationships between the magnets 47, and 48, and the sensor IC 54. In other words, relatively large amounts of displacement of the sensor IC 54 relative to the magnets 47, and 48, is allowed without resulting in a significant error in the readings of the sensor IC 54. On the other hand, if the angle θ1 is not appropriately chosen, the region of parallel magnetic lines may be limited to a relatively narrow range. Therefore, if the positional relationship between the magnets 47, and 48, and the sensor IC 54, is offset from ideal to even a small extent, an error may be present in the output signals of the sensor IC 54. For an inappropriate angle θ1, there is a small allowable tolerance in the amount of displacement of the sensor IC 54 relative to the magnets 47, and 48.

Figure 10:
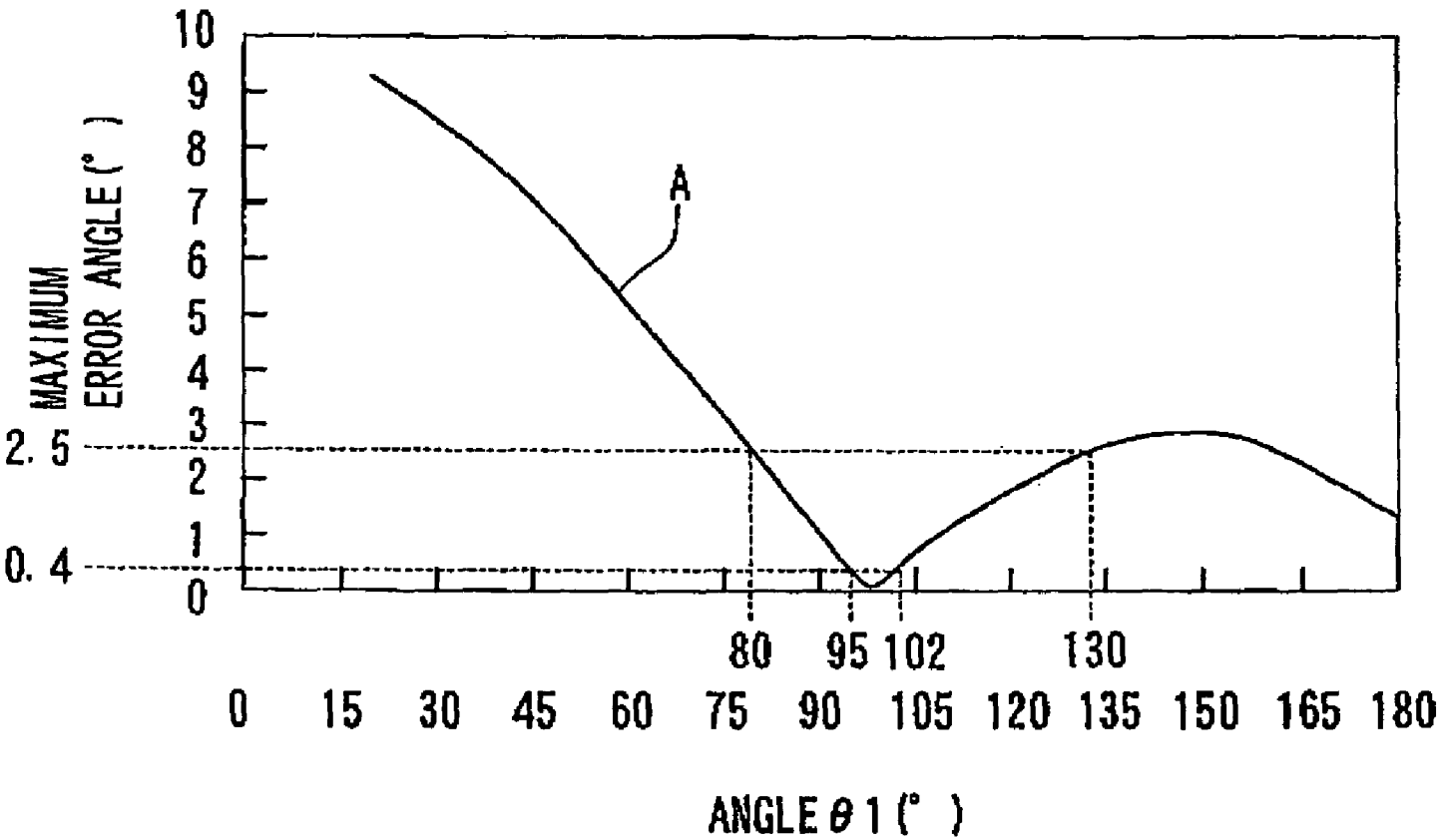
FIG. 10 is a graph illustrating the relation between the angular range of the magnets and possible maximum error of the detected angle when the position of the sensor has been offset from the center.

FIG. 10 is a graph showing experimental results of the relationship between a maximum potential error E (°) of the output signals of the sensor IC 54 and the angle θ1 (°) of the magnets 47 and 48. The maximum possible error E (°) has been measured by deviating the position of the sensor IC 54 away from an ideal set position shown in FIG. 6. The ideal set position is where the sensor IC 54 is centered on the rotational axis L and in the intermediate position of the magnets 47 and 48 located about the rotational axis L. The magnets 47 and 48 used in the experiments are made of ferritic magnetic materials. Each magnet 47 and 48 has an inner radius r (radius of the inner peripheral surface S2) of 10 mm and a thickness d of 3 mm. In an attempt to determine the maximum possible signal error E (°), the sensor IC 54 has been shifted by a distance of 0.75 mm from the ideal set position respectively in an X-direction (left and right directions as viewed in FIG. 6), a Y-direction (vertical direction as viewed in FIG. 6) and a Z-direction (left and right directions as viewed in FIG. 5). The characteristic line A indicates the results of the experiments in FIG. 10.

According to the characteristic line A shown in FIG. 10, if the desired maximum threshold value of possible error E is set to be 2.5°, an appropriate value of the angle θ1 is within the range of 80° to 130°. If the upper limit of possible error E in the detected rotation angle is set to be 0.4°, an appropriate value of the angle θ1 is within the range of 95° to 102°. The reverse is also true, by selecting a desired value of the angle θ1, the corresponding maximum possible error E can be determined. For example, if the angle θ1 is set within a range of 95° to 102°, the upper limit of permissible error may be 0.4°.

In operation of the representative throttle control device, when the engine is started the control unit, i.e., an ECU, may output control signals to the motor 4 in order to control the degree of rotation of the motor 4. As described previously, the rotational force of the motor 4 may be transmitted to the throttle valve 2 via the speed reduction mechanism 35. The throttle valve 2 is subsequently rotated to open or close the intake air channel 1*a* of the throttle body 1. As a result, the flow rate of the intake air through the intake air channel 1*a* is controlled. In addition, as the throttle shaft 9 rotates, the throttle gear 11 rotates together with the yoke 45 and the magnets 47 and 48 attached thereto. The direction of the magnetic field produced by the magnets 47 and 48 across the sensor IC 54 is altered in relation to the rotation of the magnets 47 and 48. Therefore, the output signals of the sensor IC 54 may be also be altered. The control unit may receive the output signals from the sensor IC 54. The control unit may then determine the rotational angle of the throttle shaft 9 based on the output signals. Because the sensor IC 54 detects the change of direction of the magnetic field, the output signals may not be substantially influenced by the displacement of the magnets 47 and 48 due to displacement of the throttle shaft 9 or the displacement of the sensor 55. In addition, the output signals may not be substantially influenced by a change of strength of the magnetic field due to various temperature characteristics of the magnets 47 and 48. Here, the displacement of the throttle shaft 9 means the displacement relative to the sensor IC 54. Such displacement may be caused by various reasons, such as an error in mounting the throttle shaft 9, differences in thermal expansion coefficients between the throttle body 1 and the cover 18, vibration of the throttle shaft 9 and/or the bearings 8 and/or 10 due to wear, and thermal expansion of the resin (i.e., throttle gear) that is insert molded containing the magnets 47 and 48, among other reasons.

Therefore, the sensor IC 54 can accurately detect the direction of the magnetic field, improving the accuracy of detection of the degree of opening of the throttle valve 2. This feature is particularly advantageous if the throttle body 1 is made of a resin that cannot be accurately molded. This feature is also advantageous if the throttle body 1 and the cover 18 are made of different materials from one another, such as the case in which the throttle body 1 is made of metal and the cover 18 is made of resin.

In addition, the magnets 47 and 48 are attached to the inner peripheral surface of the ring-like yoke 45. The yoke 45 is made of magnetic material and is mounted to the throttle gear 11 so as to have the same central axis as the rotational axis L of the throttle shaft 9. Furthermore, the magnets 47 and 48 are magnetized such that the magnetic lines of the magnetic field produced by the magnets 47 and 48 extend substantially parallel to one another. The magnets 47 and 48, and the yoke 45, may form a magnetic circuit such that almost all of the magnetic lines produced by the magnets 47 and 48 extend parallel to each other as shown in FIG. 7, further improving the detection accuracy of the sensor IC 54 of the direction of the magnetic field.

The angle θ1 of the magnets 47 and 48 around the rotational axis L is chosen in order to keep the error in the output signals of the sensor IC 54 (due to displacement of the magnets 47 and 48 from their ideal set positions relative to the sensor IC 54) below a predetermined value. The detection accuracy of the sensor IC 54 in determining the direction of the magnetic field can also be improved in this respect.

Figure 11:
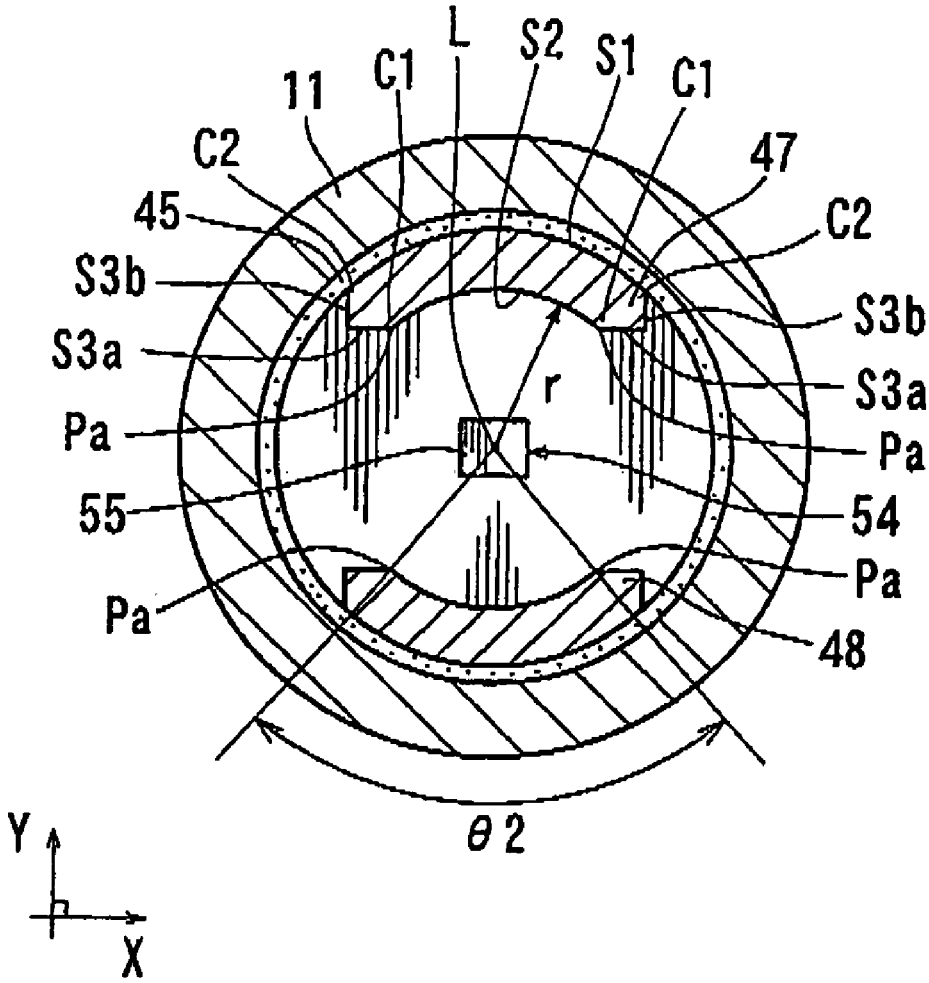
FIG. 11 is a cross sectional view similar to FIG. 6 but showing an alternative embodiment of magnets.

FIG. 11 shows alternative configurations of the magnets 47 and 48, in which each of end surfaces S3 in the circumferential direction includes a first end surface S3*a* and a second end surface S3*b*. The first end surface S3*a* extends in a direction perpendicular to the magnetizing direction of the magnets 47 and 48. The second end surface S3*b* extends parallel to the magnetizing direction. An angle θ2, defined between both ends (edges) Pa of the inner peripheral surface S2 about the rotational axis A, is determined in the same manner as the angle θ1 of the above representative embodiment.

According to an alternative configuration of the magnets 47 and 48, the inner peripheral surface S2 and the first end surface S3*a*; intersect at a corner C1 at an obtuse angle. The outer peripheral surface S1 and the second end surface S3*b* intersect at a corner C2, also by an obtuse angle. Therefore, potential damage of the corners C1 and C2 may be minimized during the machining or forming operation of the magnets 47 and 48 due to the lack of a relatively thinner, more acute corner. In addition, the first and second end surfaces, S3*a* and S3*b*, may be easily formed by a simple machining operation such as a cutting operation. With this embodiment it is possible to minimize the potential damage of the corners C1 and C2 due to possible impacts that may be applied during the assembly operation, for example, when the magnets 47 and 48 are mounted to the yoke 45. The assembly operation of the magnets 47 and 48 can be more readily facilitated.

The present invention may not be limited to the above representative embodiments but may be modified in various ways. For example, although the throttle body 1 is made of resin in the representative embodiment, the throttle body 1 may be made of metal, such as aluminum alloy. Although the throttle valve 2 is preferably made of resin, the throttle valve 2 may be made of metal, such as aluminum alloy and stainless steel. In addition, the magnets 47 and 48 may be made of any magnetic material other than ferritic magnetic materials. Although the detecting section 55 and the computing section 56 of the sensor IC 54 are integrally connected to each other, lead wires, flexible terminals, or printed circuit boards among other known electrical connection techniques, may connect them. Furthermore, the sensor IC 54 may be replaced with any other detection device as long as such a detection device can detect the direction of the magnetic field formed between the magnets 47 and 48.

This invention claims:

1. A throttle control device comprising:

a throttle body defining an intake air channel;

a throttle shaft having a rotational axis:

a throttle valve mounted to the throttle shaft and disposed within the intake air channel;

a motor coupled to the throttle shaft, wherein the motor drives the throttle valve to rotate to incrementally open and close the intake air channel so as to control a flow rate of intake air through the intake air channel: and a detection device arranged and constructed to detect a rotational position of the throttle valve, the detection device comprising:

a magnet support having an inner surface and an outer surface;

at least two magnets mounted to the throttle shaft via the inner surface of the magnet support and positioned to oppose each other across the rotational axis so as to produce a magnetic field wherein the magnets are made of ferrite-based magnetic materials and have opposite end portions in a circumferential direction about the center of rotation, and wherein the magnets are spaced from each other in the circumferential direction by gaps; wherein there is no magnetic material along an inner peripheral surface of the at least two magnets, and wherein said at least two magnets are not continuous in a circumferential direction;

a sensor mounted to the throttle body and arranged and constructed to detect a direction of the magnetic field produced by the magnets, so that the sensor outputs a signal representing the rotational position of the throttle valve.

2. A throttle control device as in claim 1, further comprising:

a ring-shaped yoke made of magnetic material and mounted to the magnet support, wherein the central axis of the yoke is substantially coincident with the rotational axis of the throttle shaft and the magnets are attached to an inner peripheral surface of the yoke, and wherein the magnets are magnetized so as to produce a substantially uniform magnetic field represented by substantially parallel, unidirectional, magnetic field lines.

3. A throttle control device as in claim 2, wherein each of the magnets extends along an angle measured about the rotational axis, and wherein the angle is determined such that an error in the outputted signal, due to an offset of a position of at least one of the magnets and the sensor relative to at least one of the other of the magnets and the sensor away from ideal set positions, is not greater than a predetermined value.

4. A throttle control device as in claim 3, wherein the magnet support comprises a throttle gear mounted to the throttle shaft.

5. A throttle control device as in claim 3, wherein the sensor further comprises:

a holder attached to the throttle body, and a sensing element disposed within the holder.

6. A throttle control device as in claim 5, wherein the holder has a bottomed tubular configuration having an open end, and wherein the sensing element is fixed in position within the holder by a resin that is filled into the holder.

7. A throttle control device as in claim 5, wherein the sensing element further comprises:

a sensing section and a computing section wherein the sensing section and the computing section are integrated with each other.

8. A throttle control device as in claim 7, wherein the sensing section has a substantially square configuration and is positioned intersecting the rotational axis of the throttle shaft.

9. A throttle control device as in claim 8, wherein the sensor further comprises:

a circuit board, and wherein the circuit board is electrically connected to the sensing element and is positioned to substantially close the open end of the holder.

10. A throttle control device as in claim 1, wherein the throttle body further comprises:

a removable cover, and wherein the sensor is mounted to the throttle body via the removable cover.

11. A throttle control device comprising:

a throttle body defining an intake air channel;

a throttle shaft having a rotational axis:

a throttle valve mounted to the throttle shaft and disposed within the intake air channel;

a motor coupled to the throttle shaft, wherein the motor drives the throttle valve to rotate to incrementally open and close the intake air channel so as to control a flow rate of intake air through the intake air channel: and a throttle sensor arranged and constructed to detect an angle of the throttle valve, the throttle sensor comprising:

two magnets having poles and mounted to the throttle shaft via a magnet support and positioned to oppose each other across the rotational axis so as to produce a magnetic field wherein the magnets are made of ferrite-based magnetic materials and have opposite end portions in a circumferential direction about the center of rotation, and wherein the magnets are spaced from each other in the circumferential direction by gaps; wherein the two magnets are not continuous with each other in the circumferential direction and there is no magnetic material between the poles of the magnets;

a ring-shaped yoke made of magnetic material and mounted to the magnet support;

a sensor mounted to the throttle body and arranged and constructed to detect a direction of the magnetic field produced by the magnets, so that the detection device outputs a signal representing the angle of the throttle valve; wherein the sensor comprises;

a sensing section, and a computing section, and wherein the central axis of the yoke is substantially coincident with the rotational axis of the throttle shaft and the magnets are attached to an inner peripheral surface of the yoke, and wherein the magnets are magnetized so as to produce a substantially uniform magnetic field represented by substantially parallel, unidirectional, magnetic field lines at least across the sensing section, and wherein each of the magnets extends along an angle measured about the rotational axis, and wherein the angle is determined such that an error in the outputted signal, due to an offset of a position of at least one of the magnets and the sensor relative to at least one of the other of the magnets and the sensor away from ideal set positions, is not greater than a predetermined value.

12. A throttle control device as in claim 11, wherein the throttle body further comprises:

a cover, and wherein the sensor further comprises:

a holder, and wherein the holder comprises a substantially cylindrical cavity closed on one end, and wherein at least the sensing section is located within the holder, and wherein the holder is attached to the cover.

13. A throttle control device as in claim 12, wherein the sensor further comprises a circuit board, and wherein the circuit board is electrically connected to the sensing section and is positioned to substantially close the open end of the holder.

14. A throttle control device as in claim 13, wherein the holder further comprises a resin material, wherein the resin material fills the interior cylindrical cavity and fixes at least the sensing section in a stable position.

15. A throttle control device as in claim 11, wherein the throttle body is made of a resin material.

16. A throttle control device as in claim 11, wherein the throttle body is made of a metal material.

17. A throttle control device comprising:

a throttle body defining an intake air channel;

a throttle shaft having a magnetic support radial surface:

a throttle valve mounted to the throttle shaft and disposed within the intake air channel;

a motor coupled to the throttle shaft, wherein the motor drives the throttle valve to rotate to incrementally open and close the intake air channel so as to control a flow rate of intake air through the intake air channel: and a detection device arranged and constructed to detect a rotational position of the throttle valve, the detection device comprising:

at least two magnets positioned to produce a magnetic field across a center of rotation, wherein the magnets each include an inner and outer surface and a first and second end portion, further wherein each of the magnets outer surface is attached to the magnetic support radial surface and each of the magnets first and second ends are spaced from each other in the circumferential direction by gaps; wherein the at least two magnets are not continuous with each other in the circumferential direction and there is no magnetic material between the at least two magnets in a diametric direction;

a sensor mounted to the throttle body and arranged and constructed to detect a direction of the magnetic field produced by the magnets, so that the sensor outputs a signal representing the rotational position of the throttle valve.

18. A throttle control device as in claim 17, further comprising:

a ring-shaped yoke made of magnetic material and mounted to the magnet support, wherein the central axis of the yoke is substantially coincident with the rotational axis of the throttle shaft and the magnets are attached to an inner peripheral surface of the yoke, and wherein the magnets are magnetized so as to produce a substantially uniform magnetic field represented by substantially parallel, unidirectional, magnetic field lines.

19. A throttle control device as in claim 17, wherein the magnet end portions are defined by a surfaces is substantially perpendicular to the direction of the magnetic field that extends across the center of rotation.

20. A throttle control device as in claim 17, wherein the magnet end portions are defined by a surface that is substantially parallel to the direction of the magnetic field that extends across the center of rotation.

21. A throttle control device comprising:

a throttle body defining an intake air channel;

a throttle shaft having an inner and outer magnetic support surface:

a throttle valve mounted to the throttle shaft and disposed within the intake air channel;

a motor coupled to the throttle shaft, wherein the motor drives the throttle valve to rotate to incrementally open and close the intake air channel so as to control a flow rate of intake air through the intake air channel: and a detection device arranged and constructed to detect a rotational position of the throttle valve, the detection device comprising:

at least two magnets positioned to produce a magnetic field across a center of rotation, wherein the magnets each include an inner and outer surface and a first and second end portion, further wherein each of the magnets outer surface is attached to the inner magnetic support surface and each of the magnets first and second ends are spaced from each other in the circumferential direction by gaps; wherein the is no magnetic material between an inner peripheral surface of the at least two magnets and around the sensor, and between the first and second end portions; and a sensor mounted to the throttle body and arranged and constructed to detect a direction of the magnetic field produced by the magnets, so that the sensor outputs a signal representing the rotational position of the throttle valve.

22. A throttle control device comprising:

a throttle body defining an intake air channel;

a throttle shaft having a rotational axis;

a throttle valve mounted to the throttle shaft and disposed within the intake air channel;

a motor coupled to the throttle shaft, wherein the motor drives the throttle valve to rotate to incrementally open and close the intake air channel so as to control a flow rate of intake air through the intake air channel; and a detection device arranged and constructed to detect a rotational position of the throttle valve; wherein the detection device comprises:

a magnet support having an inner surface and an outer surface;

at least two magnets mounted to the throttle shaft via said inner surface of the magnet support and positioned to oppose each other across the rotational axis so as to produce a magnetic field wherein the magnets are made of ferrite-based magnetic materials and have opposite end portions in a circumferential direction about the center of rotation, and wherein the magnets are spaced from each other in the circumferential direction by gaps;

a sensor mounted to the throttle body and arranged and constructed to detect a direction of the magnetic field produced by the magnets, so that the sensor outputs a signal representing the rotational position of the throttle valve;

wherein there is no magnetic material around the sensor and within at least one of the gaps.

* * * * *